US005560509A

United States Patent [19]

Laverman et al.

[11] Patent Number: 5,560,509

[45] Date of Patent: Oct. 1, 1996

[54] GUIDE POLE FITTING SEAL FOR FLOATING ROOF STORAGE TANKS

[75] Inventors: Royce J. Laverman, South Holland; John E. Owens, Jr., Joliet, both of Ill.

[73] Assignee: Chicago Bridge & Iron Technical Services Company, Oak Brook, Ill.

[21] Appl. No.: 215,377

[22] Filed: Mar. 21, 1994

[51] Int. Cl.[6] ..... B65D 88/48; B65D 88/46

[52] U.S. Cl. ..... 220/217; 220/216; 220/224

[58] Field of Search ..... 220/216, 217, 220/220, 221, 222, 223, 224

[56] References Cited

U.S. PATENT DOCUMENTS

| | | | |
|---|---|---|---|
| 1,611,440 | 12/1926 | Haupt . | |
| 2,237,461 | 4/1941 | Tokheim | 220/221 |
| 3,474,931 | 10/1969 | Daniels . | |
| 3,583,594 | 6/1971 | Belanger | 220/222 |
| 4,243,151 | 1/1981 | Bruening . | |
| 4,260,068 | 4/1981 | McCarthy | 220/221 |
| 4,468,975 | 9/1984 | Sayles et al. . | |
| 5,423,446 | 6/1995 | Johnson | 220/221 |

FOREIGN PATENT DOCUMENTS

| | | | |
|---|---|---|---|
| 0793872 | 1/1981 | U.S.S.R. | 220/216 |
| 984665 | 3/1965 | United Kingdom . | |
| 1176106 | 1/1970 | United Kingdom | 220/222 |
| WO94/03782 | 2/1994 | WIPO . | |

OTHER PUBLICATIONS

PCT/US95/02995 International Search Report.

"Evaporative Loss From External Floating–Roof Tanks", API Publication 2517 Third Edition, Feb. 1989, American Petroleum Institute.

Engineering Drawing—8 inch diameter Gage Well Guide Pole, Sep. 9, 1992.

Engineering Drawing—Misc. Parts for 8–inch diameter Guide Pole, Sep. 9, 1992.

Engineering Drawing—Seal Well for Guide Pole, Dec. 20, 1991.

Engineering Drawing —10–inch diameter Gage Well Guide Pole, Dec. 20, 1991.

PCT Written Opinion, 4 Apr. 1996.

*Primary Examiner*—David Scherbel
*Assistant Examiner*—Randall E. Chin
*Attorney, Agent, or Firm*—Marshall, O'Toole, Gerstein, Murray & Borun

[57] ABSTRACT

A guide pole fitting seal for use on floating roof tanks that incorporates a well gasket, pole sleeve, pole wiper, float and float wiper that may be used with guide poles to control emissions from the guide pole fitting. The guide pole seal may permit the product level in the tank to be measured and sampled from inside of the guide pole by removing the float during these operations.

42 Claims, 5 Drawing Sheets

GUIDE POLE FITTING SEAL FOR FLOATING ROOF STORAGE TANKS

BACKGROUND OF THE INVENTION

The present invention relates generally to floating roof tanks and more specifically to methods and apparatus for sealing the guide pole opening in the floating roof to reduce emissions of vapor from the tank.

Ambient air quality has become an increasingly important concern in recent years. Many air pollutant emission sources that were tolerated in years past are now facing regulations which force significant reductions or elimination of such emissions. One category of such emission sources is aboveground storage tanks for the storage of volatile liquids.

Although there are other types of aboveground storage tanks for the storage of volatile liquids, one type of such tank in wide use is referred to as an external floating-roof tank. This type of tank has a circular essentially flat bottom, a vertical cylindrical shell having a lower edge joined to the tank bottom and an external floating roof adapted to float on the volatile liquid stored in the tank. The rim space, which is located between the floating roof rim and the inside surface of the tank shell, is sealed by one of several rim sealing means attached to and movable vertically simultaneously with the floating roof so as to reduce emissions to the atmosphere from the rim space. Some such seals are disclosed in the U.S. Pat. Numbers: Moyer U.S. Pat. No. 2,829,795; Harris et al. U.S. Pat. No. 2,968,420; Reese U.S. Pat. No. 3,075,668; Wissmiller U.S. Pat. No. 3,120,320; Moyer U.S. Pat. No. 3,136,444; and Bruening U.S. Pat. No. 4,406,377.

The floating roof moves vertically upward when the storage tank is filled with product, and moves vertically downward when product is withdrawn from the storage tank. Although the external floating roof is permitted to move in a vertical direction and, to a lesser extent, in a radial direction, it is necessary to provide guides to prevent rotation of the floating roof so as to prevent damage to other appurtenances on the floating roof such as rolling ladders, rainwater drain systems, and automatic level gauges.

To prevent rotation of the floating roof, a guide pole is commonly used. The guide pole is located inside of the storage tank near the tank shell and is fixed at the bottom to the tank bottom and is fixed at the top to the top of the tank shell. The guide pole penetrates the floating roof through a guide pole fitting, which results in a source of emissions to the atmosphere.

Gauging the product liquid level in the storage tank or obtaining samples of the product in the storage tank has been done utilizing the interior of the guide pole. To facilitate gauging and sampling operations, the guide pole is hollow and has openings to allow the product inside of the guide pole to freely mix with product outside of the guide pole so that the composition and liquid level inside of the guide pole are the same as that outside of the guide pole in the storage tank. These openings are often in the form of vertical columns of slots which overlap on alternating rows so that at any vertical position there is always communication between the liquid within the guide pole and the liquid outside of the guide pole.

The wind has been found to have an important effect in causing emissions from certain types of roof fittings and wind tunnel tests have been performed to measure the emission loss factors of different types of floating roof fittings, including guide pole fittings. A wind tunnel simulated the flow of atmospheric air over the floating roof fittings, as occurs on external floating roofs, and revealed that the guide pole fitting had the highest emissions of all of the fittings tested. In fact, one type of commonly used guide pole fitting had emissions that were about 25 times the emissions from the entire rim seal of an external floating roof.

Therefore, it is desirable to incorporate emission control features in guide pole fittings to reduce the emission loss factors.

SUMMARY OF THE INVENTION

According to the present invention, a guide pole fitting seal is provided for a tank having a floating roof and a guide pole well in the floating roof defining an opening through which a guide pole extends, the guide pole fitting seal including a well gasket supported by the guide pole well, a sliding cover supported by the well gasket, the sliding cover defining an opening through which the guide pole extends, a pole sleeve joined to and extending downwardly from the sliding cover to at least the level of product stored in the tank, the pole sleeve defining a bore through which the guide pole extends, and a pole wiper joined to the sliding cover in wiping engagement with the guide pole. There may also be a float having means for floating on liquid product within the guide pole when it has openings through which liquid product circulates, and a float wiper joined to the float and in wiping engagement with the inside of the guide pole.

There may also be a fixed cover joined to the guide pole well which supports the well gasket, the fixed cover also defines an opening through which the slotted pole extends.

To minimize the load on various seal elements, a guide may be provided that carries some of the load of the floating roof as it tends to rotate. The guide may include a roller assembly that consists of a separate roller on each side of the guide pole with the axis of the roller oriented parallel to the radius from the center of the floating roof to the center of the guide pole.

To maintain contact between the well gasket and the sliding cover, a retainer attached to the floating roof may be used. In one embodiment, a retainer angle may be joined to each sliding cover guide angle to define a slot parallel to the radius from the center of the floating roof to the center of the guide pole to permit radial sliding of the sliding cover while maintaining contact between the sliding cover and the well gasket.

The pole sleeve has been found to be an important element in controlling emissions from guide pole fittings and particularly important when used with slotted guide poles because it blocks wind driven air that would otherwise pass between the fixed cover and the sliding cover into the well vapor space, mix with product vapor, flow into the guide pole through the exposed vapor space openings, flow upward and exit through the openings in the guide pole that are above the sliding cover. The guide pole sleeve has been found to be very effective in reducing emissions when it is used in combination with the other emission control features that are part of this invention, resulting in a roof fitting loss factor of 106 pound-moles per year at an ambient wind speed of 10 miles per hour, as compared to a roof fitting loss factor of about 5000 pound-moles per year at the same wind speed for a guide pole fitting which does not incorporate these emission control features. Flexible guide pole sleeves may be installed in existing tanks through the guide pole hole in the sliding cover without taking the tank out of service.

The roller assembly may be used in combination with the emission control features to facilitate vertical movement of the floating roof while restraining rotation of the floating roof about its vertical axis. The roller assembly also withstands most of the rotational forces that could otherwise damage the pole wiper and pole sleeve, and impair their ability to properly seal the space between the outside surface of the guide pole and the inside surface of the pole sleeve.

DETAILED DESCRIPTION OF THE INVENTION

To the extent that it is reasonable and practical, the same elements which appear in the various drawing figures will be identified by the same numbers.

Figure 1:
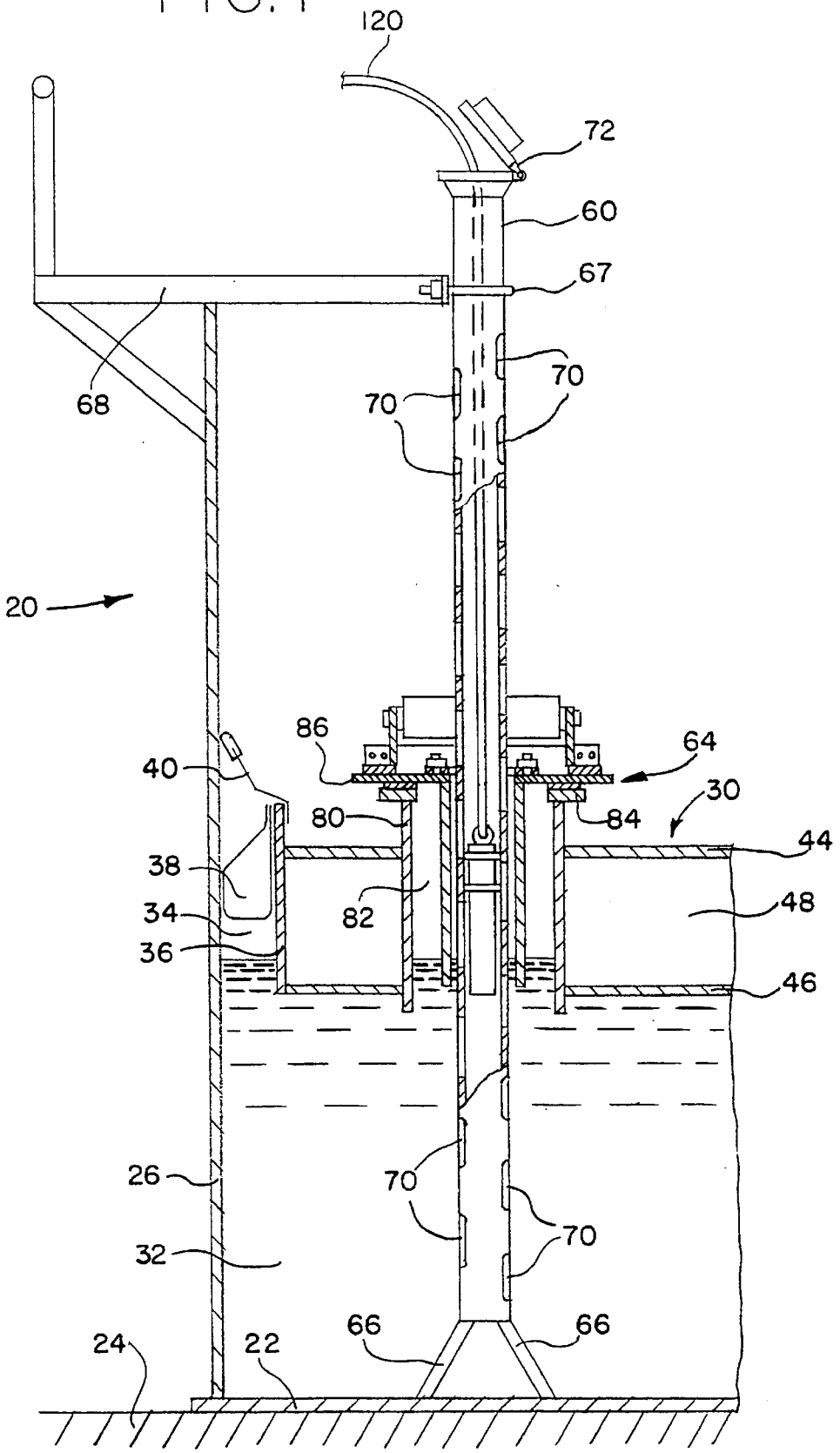
FIG. 1 is an elevation section view of a portion of an external floating-roof tank illustrating a slotted guide pole and guide pole fitting in accordance with the present invention.

FIG. 1 illustrates a portion of an external floating roof tank 20. The tank 20 includes a flat circular bottom 22 resting on a suitable foundation 24 above ground level. A vertical cylindrical tank shell 26 is joined to the bottom 22 and extends upwardly. A floating roof 30 is positioned inside the tank shell 26 such that it floats on top of liquid product 32 within the tank 20 and defines a roughly annular rim space 34 around its outer vertical rim 36.

The annular rim space 34 is substantially sealed using any conventional rim seal system that may include a mechanical or resilient, primary seal 38 and an optional wiping, secondary seal 40. The primary seal 38 and the secondary seal 40 reduce vapor emissions from the annular rim space 34 around the floating roof 30 and permit limited radial movement of the floating roof but provide little resistance to rotational movement.

The floating roof 30 can be of any conventional construction, but typically includes an upper deck 44 and a lower deck 46 which are joined by vertical support plate 48 and the vertical rim 36 to define an enclosed space that aids in adding buoyancy to the floating roof 30. The lower deck 46 floats in direct contact with product 32 and the upper deck 44 provides a platform for supporting workmen and equipment.

External floating roof tank 20 can be used to store a wide variety of volatile liquid products 32 such as gasoline, jet engine fuel, kerosene, and other highly volatile liquid hydrocarbons, many of which become combustible when mixed with the right amount of air.

The present invention is also useful in reducing the evaporation loss of stored product even when used with internal floating roof tanks which have a fixed roof positioned over a floating roof.

The floating roof 30 moves vertically during tank filling and emptying operations, but its rotation about a vertical axis must be limited to prevent damage to certain external floating roof tank 20 components, such as the rim seal system 38 and 40, automatic level gauging devices, rolling ladders that extend from the top of the tank shell 26 to the top of the external floating roof 30, and floating roof rain water drainage systems.

To prevent rotation of the external floating roof 30, a guide pole 60 is used which rests on lower supports 66 and is secured a gauger's platform 68 at an upper support 67. The guide pole 60 penetrates the external floating roof 30 at a guide pole fitting 64 which is illustrated in FIG. 1 in accordance with the present invention.

In addition to preventing rotation of the floating roof 30, the guide pole 60 is often used to sample and determine the liquid level of the product 32 in the storage tank 20. In order to obtain representative samples or determine accurate product levels of product 32 inside of the tank 20, the guide pole 60 commonly incorporates openings 70 to permit free communication of the product 32 in the storage tank 20 with that portion of the product 32 inside of the guide pole 60. A gauge hatch 72 is provided at the top of the guide pole 60 to permit the tank gauger to sample and gauge the product 32 inside of the guide pole 60.

Figure 2:
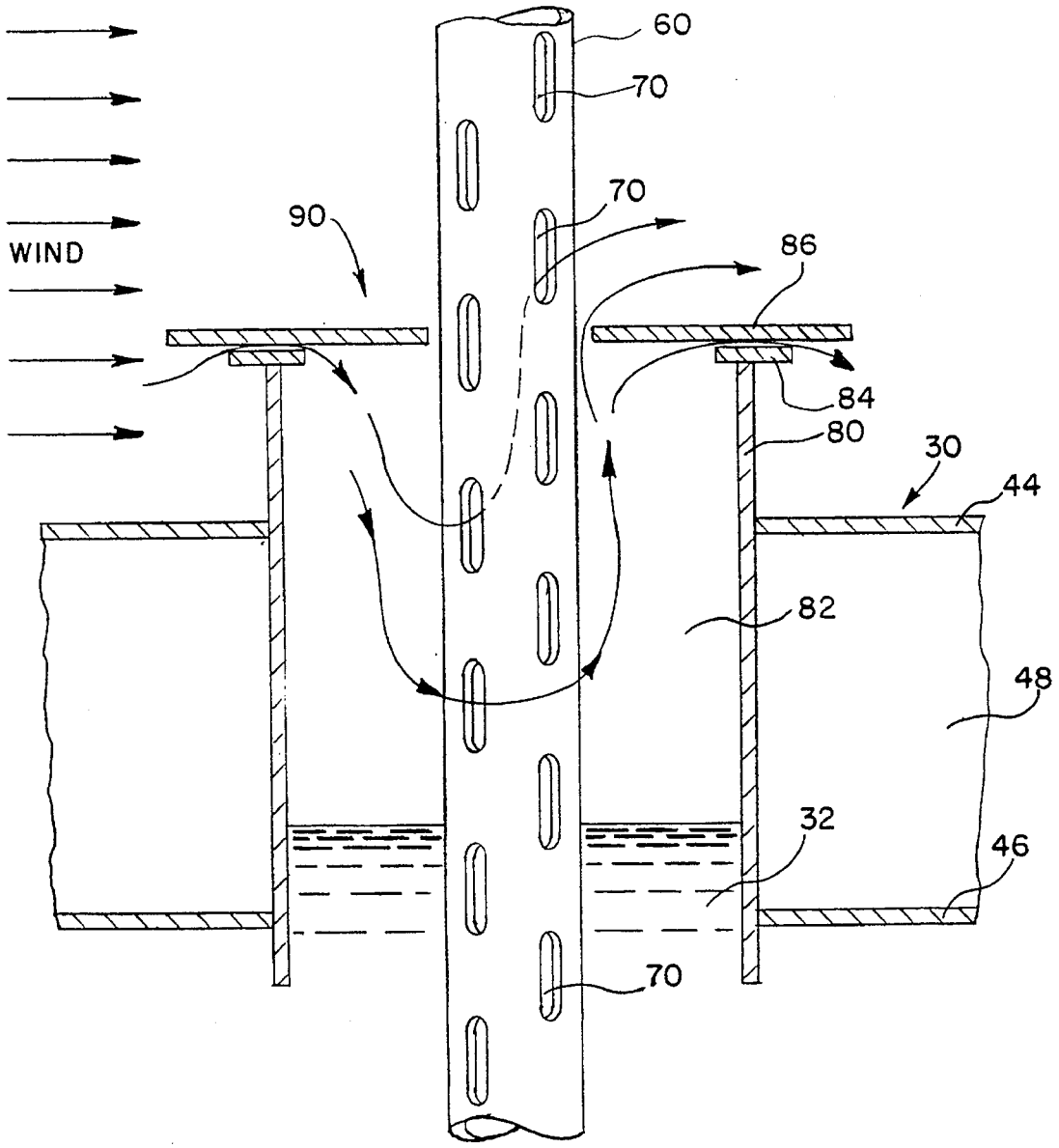
FIG. 2 is an elevation section view through a typical guide pole fitting that does not incorporate the emission control features of this invention, and illustrates the mechanism of emissions from a guide pole fitting that does not have the emission control features of this invention.

One method of providing openings 70 in a guide pole 60 involves the use of vertical columns of slots, where the slots 70 in the various columns are spaced apart around the circumference of the guide pole 60, and vertically overlap as illustrated in FIG. 2 to provide continuous communication of the product 32 inside the guide pole 60 with the product 32 inside of the storage tank 20 at all levels within the tank 20. Other shapes and arrangements of guide pole openings 70 can be used with the present invention.

Figure 4:
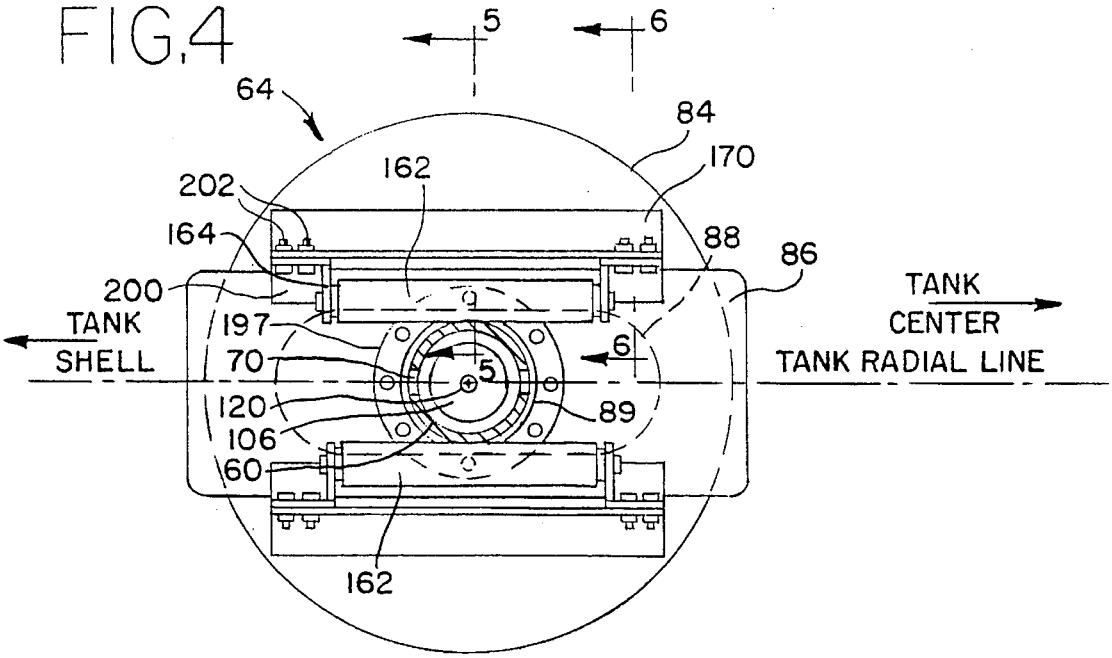
FIG. 4 is a plan view of the guide pole fitting that incorporates the emission control features of this invention.

A typical guide pole fitting includes a vertical cylindrical guide pole well 80 that defines a bore through which guide pole 60 extends, and that defines a well vapor space 82. The guide pole well 80 need not extend upward beyond, and may be flush with, the upper deck 44 of floating roof 30. On top of the guide pole well 80 there is welded a fixed cover 84 that provides an upper horizontal bearing surface on which a sliding cover 86 rests. The fixed cover 84 defines an elongated hole 88 (See: FIG. 4) with a longitudinal axis that is substantially parallel to the radius that extends from the center of the floating roof 30 to the center of the guide pole 60. The elongated hole 88 permits the floating roof 30 to move radially but not rotationally. The sliding cover 86 defines a hole 89 that is roughly the same shape as the guide pole 60 (illustrated as circular in FIG. 4) so that the sliding cover 86 is maintained adjacent to the guide pole 60 and yet is free to move vertically along the guide pole 60. As the floating roof 30 moves radially in and out from the center of the tank 20, fixed cover 84 slides under sliding cover 86 and the floating roof 30 is restrained from rotation by the guide pole 60 bearing on the guide pole fitting 64.

The use of a guide pole 60 having openings 70 and that penetrates the external floating roof 30 through a guide pole fitting, however, has been found to cause a large rate of atmospheric emissions. FIG. 2 illustrates a type of guide pole fitting construction 90 that has been commonly used on external floating-roof tanks 20. It includes a guide pole well 80, a fixed cover 84, and a sliding cover 86 similar to some of the basic components of the guide pole fitting 64 illustrated in FIG. 1. Wind-tunnel tests have been conducted on guide pole fittings 90 of the type illustrated in FIG. 2 to determine their evaporative loss or atmospheric emission characteristics. These test results were used to prepare American Petroleum Institute (API) Publication 2517, "Evaporative Loss from External Floating-Roof Tanks," 3rd Edition, February 1989. This publication describes the method for calculating evaporative loss from floating roof fittings. The loss from each type of floating roof fitting may be calculated using Equation 1:

$$L_f = K_f P^* M_v K_c \qquad \text{(Equation 1)}$$

where:

$L_f$=evaporative loss from the type of roof fitting being considered, in pounds per year;

$K_f$=roof fitting loss factor, in pound-moles per year;

$P^*$=vapor pressure function (dimensionless);

$M_v$=average stock vapor molecular weight, in pounds per pound-mole; and $K_c$=product factor (dimensionless).

In Equation 1, the roof fitting loss factor, $K_f$, depends only upon the construction features of the floating roof fitting and upon the ambient wind speed. The other factors in Equation 1 depend upon the characteristics of the stored product and are independent of the type of floating roof fitting being considered. Thus, to compare the evaporative loss control of different types of floating roof fittings, it is only necessary to compare their roof fitting loss factors, $K_f$.

Table A lists the roof fitting loss factors, $K_f$, at ambient wind speeds of 5, 10 and 15 miles per hour of 9 different types of roof fittings commonly used on external floating roofs.

TABLE A

Roof Fitting Loss Factors, $K_f$ (pounds-moles per year), for Various Roof Fitting Types and Construction Details

| Fitting Number | Roof Fitting Type and Construction Details | Roof Fitting Loss Factor $K_f$ Wind Speed 5 m.p.h. | Wind Speed 10 m.p.h. | Wind Speed 15 m.p.h. |
|---|---|---|---|---|
| 1 | ACCESS HATCH Bolted Cover, Gasketed | 0 | 0 | 0 |
| 2 | RIM VENT Weighted Actuation, Gasketed | 1.21 | 1.71 | 2.21 |
| 3 | GAUGE-HATCH/ SAMPLE WELL Weighted Actuation, Gasketed | 1.65 | 2.35 | 3.05 |
| 4 | VACUUM BREAKER Weighted Actuation, Gasketed | 2.05 | 2.90 | 3.75 |
| 5 | ROOF LEG Adjustable, Pontoon Area | 2.50 | 3.50 | 4.50 |
| 6 | GAUGE-FLOAT WELL Unbolted Cover, Ungasketed | 31.8 | 61.3 | 90.8 |
| 7 | OVERFLOW ROOF DRAIN Open | 66.6 | 176 | 310 |
| 8 | GUIDE POLE FITTING Unslotted Guide Pole, Sliding Cover, Ungasketed | 324 | 640 | 952 |
| 9 | GUIDE POLE FITTING Slotted Guide Pole, Sliding Cover, Ungasketed | 2,139 | 4,913 | 7,992 |

The roof fitting loss factors listed in Table A are based upon the values contained in API Publication 2517, which was mentioned above. Table A illustrates the fact that guide pole fittings have the highest roof fitting loss factors. In particular, guide poles that contain openings or slots for the purpose of tank gauging and product sampling have the highest loss factors listed in Table A. For example, at an ambient wind speed of 10 miles per hour, a slotted guide pole fitting has a roof fitting loss factor of 4,913 pound-moles per year. In comparison, at an ambient wind speed of 10 miles per hour, the roof fitting loss factor for the entire rim seal on an external floating-roof tank that is 100 foot in diameter would be only about 200 pound-moles per year when a double rim seal system is used, which is a rim seal system that consists of a combination primary rim seal and secondary rim seal. Thus, the roof fitting loss factor for the slotted guide pole fitting is about 25 times that from the entire floating roof rim seal system. This comparison highlights the importance of incorporating more effective emission control construction features in guide pole fittings.

The wind tunnel tests that were performed to measure the roof fitting loss factors of guide pole fittings also revealed the mechanisms involved in evaporative loss from guide pole fittings of the construction illustrated by FIG. 2. Air flows across the guide pole fitting 90 are represented by arrows and illustrate how air enters the well vapor space 82 by flowing between any gap present between the fixed cover 84 and the sliding cover 86 on the upwind side of the guide pole fitting 90. This air then mixes with product 32 vapor in the well vapor space 82 and exits through a combination of the three paths illustrated in FIG. 2. First, air laden with product vapor exits the well vapor space 82 through gaps between the fixed cover 84 and the sliding cover 86 on the downwind side of the guide pole fitting 90. Second, air laden with product vapor exits the well vapor space 82 through gaps between the sliding cover 86 and the guide pole 60 on the downwind side of the guide pole fitting 90. Third, air laden with product vapor flows into the guide pole slots 70 that are exposed to the well vapor space 82, flows vertically upward inside the slotted guide pole 60, and exits the slots 70 that are located above the sliding cover 86.

Figure 3:
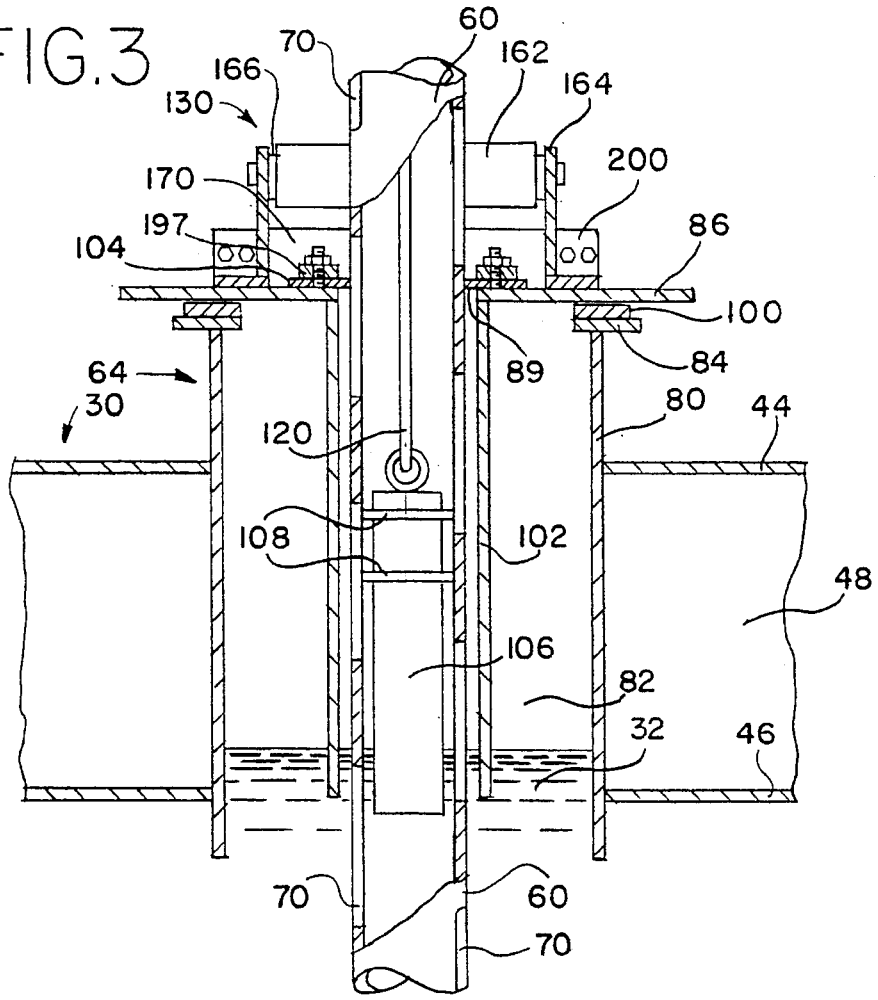
FIG. 3 is an elevation section view through a guide pole fitting that incorporates the emission control features of this invention.

Based on this understanding of the evaporative loss mechanisms from previous slotted guide pole fittings 90, novel evaporative loss control construction features of the present invention were incorporated into the guide pole fitting 64 (illustrated in FIGS. 1 and 3 through 9) to reduce the evaporative loss rate. These features include a well gasket 100, a pole sleeve 102, a pole wiper 104, a float 106, and float wipers 108. When these emission control construction features are used in combination, as illustrated in FIG. 3, a significant reduction occurs in the roof fitting loss factor, $K_f$, for the slotted guide pole fitting 64.

Table B lists the roof fittings loss factors, $K_f$, of guide pole fittings that incorporate these evaporative loss control features at wind speeds of 5, 10 and 15 miles per hour. In Table B, Fitting Number 1 is listed for comparison, since it does not incorporate any of the evaporative loss control features that are part of this invention. In Table B, Fitting Number 5 incorporates all of the evaporative loss control features that are part of this invention and results in a roof fitting loss factor of 106 pound-moles per year at a wind speed of 10 miles per hour. This is a reduction in the roof fitting loss factor of 98 percent from the roof fitting loss factor for Fitting Number 1 in Table B, illustrating the effectiveness of these emission control features when incorporated in a guide pole fitting 64.

The wiping contact of the pole wiper 104 and the float wipers 108 provides an effective vapor seal that also wipes clingage of liquid product off of the guide pole 60 that could otherwise be exposed to the atmosphere when the floating roof 30 descends. Once exposed to the atmosphere, the clingage evaporates and results in a loss of valuable product.

The floating roof tank 20 may be used to store volatile liquid products that are flammable, and are therefore combustible when mixed with air. To avoid combustion, it is desirable to use materials in the guide pole fitting seal that are not likely to cause a spark as they move past one another. Thus, the sliding cover 86 and the pole sleeve 80 are preferably made of stainless steel, brass, or aluminum.

The pole sleeve 102 may be made of metal, plastic or fabric so long as it does not hang up on the guide pole 60 during vertical or radial movement of the floating roof 30 and functions to block the flow of wind around the guide pole 60 to reduce the emissions that result from the wind flow as illustrated in FIG. 2.

Flexible pole sleeves may be particularly useful in retrofitting existing tanks with that feature of the invention. This may be accomplished in some installations without taking the tank 20 out of service by simply inserting the flexible pole sleeve 80 down the annular space between the outside surface of the guide pole 60 and the inside edge of the hole 89 in the sliding cover 86 into the stored product 32 and securing it to the sliding cover 86. The flexible sheet material

TABLE B

Roof Fitting Loss Factors, $K_f$, (pound-moles per year) for Guide Pole Fittings Used With Slotted Guide Poles

| | Guide Pole Fitting Description | | | | | Roof Fitting Loss Factor $K_f$ | | | |
|---|---|---|---|---|---|---|---|---|---|
| Fitting Number | Well Gasket | Float | Float Wiper | Pole Sleeve | Pole Wiper | Wind Speed 5 m.p.h | Wind Speed 10 m.p.h. | Wind Speed 15 m.p.h. | Notes |
| 1 | No | No | No | N/A | N/A | 2139 | 4913 | 7992 | 1 |
| 2 | Yes | No | No | N/A | N/A | 1794 | 4121 | 6703 | 1 |
| 3 | No | Yes | Yes | N/A | N/A | 725 | 2900 | 6525 | 1 |
| 4 | Yes | Yes | Yes | N/A | N/A | 405 | 2135 | 5650 | 1 |
| 5 | Yes | Yes | Yes | Yes | Yes | 55 | 106 | 156 | 2 |

Notes:
1 The loss factors of Fitting Nos. 1 through 4 are from the American Petroleum Institute, Publication 2517, "Evaporative Loss from External Floating-Roof Tanks", Third Edition, February 1989.
2 These loss factors were measured in a wind tunnel on a guide pole fitting constructed in accordance with this invention.

FIGS. 3 and 4 illustrate a guide pole fitting 64 that incorporates all of the emission control features of the present invention, namely: a well gasket 100 located between the fixed cover 84 and the sliding cover 86; a pole sleeve 102 completely surrounding the guide pole 60 and extending downward from the sliding cover 86 into the liquid product 32; a pole wiper 104 attached to the sliding cover 86 and extending over the space between the outside surface of the guide pole 60 and the inside surface of the pole sleeve 102, and in continuous wiping contact with the outside surface of the slotted guide pole 60 in the area adjacent to the pole wiper 104; a vertical cylindrical float 106 that is contained inside the slotted guide pole 60 and which floats in the product 32 that is contained within the slotted guide pole 60, effectively reducing the amount of exposed product 32 liquid surface area within the slotted guide pole 60; and at least one float wiper 108 which is attached to the float 106 and is in continuous wiping contact with the inside surface of the slotted guide pole 60, effectively covering the gap between the inside surface of the guide pole 60 and outside surface of the float 106.

may be a non-metallic material similar to that used for the wipers and gaskets or it may be a resilient sheet of plastic or metal.

The fixed cover 84 provides a convenient horizontal bearing surface for the well gasket 100, but it is optional and could be omitted and replaced by the flat surface of the upper deck 44 of the floating roof 30 or the well gasket 100 could be positioned on the top of the guide pole well 80 and secured by any conventional means.

The well gasket 100, pole wiper 104 and float wiper 108 must be constructed of materials that are compatible with the chemical characteristics of the product 32. The material used must be selected to provide durability under the expected operating conditions. In particular, the pole wiper 104 and float wiper 108 material must have sufficient abrasion resistance to permit continued operation over the desired life of the guide pole fitting 64 prior to maintenance work. For a wide range of petroleum products, Chloroprene (Neoprene), Acrylonitrile-Butadiene Poly Vinyl Chloride (Buna-N/Vinyl), Hypalon, Polyurethane, and Fluorelastomer (Viton) are acceptable seal and gasket materials. Also useful are durable materials made of fiber or fabric reinforced plastics such as Neoprene on Nylon fabric, Polyurethane on Nylon or Polyester fabric, Buna-N/Vinyl on Nylon fabric, or Viton on Nylon fabric. One other suitable material is made of Viton on one side and Buna-N/Vinyl on the other side of Nylon fabric. It should be understood that the seals and gaskets function to prevent a substantial amount of emission loss, but are not absolute in their sealing ability.

The float 106 may be fabricated from a metal cylinder with closed ends, with an empty interior space that results in a weight appropriate for floating in the intended product 32. Alternatively, the float 106 may be fabricated of a non-metal cylinder with closed ends, such as Polyurethane or Polyethylene, with the interior left empty or filled with a closed cell polymeric foam material, such as Polyurethane foam. At least one float wiper 108 may be used to provide a seal between the inside surface of the guide pole 60 and the outside surface of the float. A plurality of float wipers 108 may also be used to provide a more effective seal between the inside surface of the guide pole 60 and the outside surface of the float 106. A cable 120 is attached to the top of the float 106 and extends vertically upward to the top of the guide pole 60 to permit removal of the float 106 during product 32 gauging or sampling operations.

During tank filling and emptying operations, the floating roof 30 rises or descends, respectively, to accommodate the change in volume of the stored product 32. It is important that the forces transmitted by the floating roof 30 to the guide pole 60 not interfere with the proper operation of the pole sleeve 102 or pole wiper 104. Therefore, a guide, such as a roller assembly 130, can be used to help control the rotational forces of the floating roof 30 on the pole sleeve 102 and pole wiper 104 and to transmit these forces instead to the fixed cover 84 or to the floating roof 30. The roller assembly 130 includes rollers 162, roller support plates 164, and roller shaft bushings 166. The roller support plates 164 are connected to the sliding cover retainer angles 200 in a manner that permits rotation of the rollers 162 as the floating roof 30 rises or descends. The rollers 162 are oriented so that the axis of the rollers is horizontal and parallel to the radial line that extends from the center of the floating roof 30 through the center of the guide pole 60. The openings 70 in the guide pole 60 are preferably located in areas of the guide pole 60 where contact between the rollers 162 and the guide pole 60 does not occur so as to permit better transmission of forces between the guide pole 60 and the rollers 162. For example, the openings 70 may be located on the radial line that extends from the center of the floating roof 30 through the center of the guide pole 60, as illustrated in FIG. 4.

For some floating roof storage tanks 20, an alternative floating roof guide may be used to control rotation of the floating roof 30. In these cases, the slotted guide pole 60 may be used primarily for measuring the product 32 level and sampling the product 32, and the roller assembly 130 may not be required to control the rotation of the floating roof.

Figure 5:
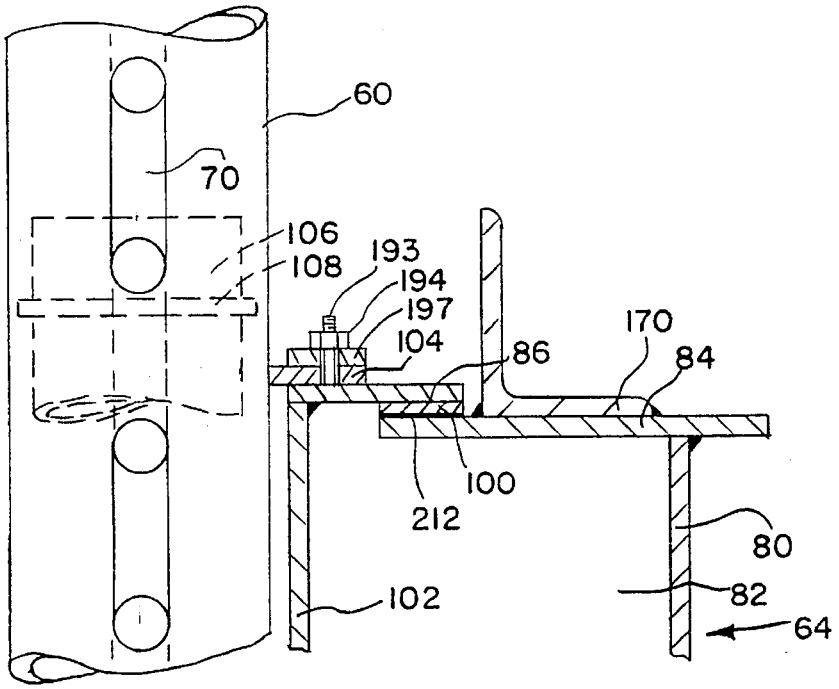
FIG. 5 is an elevation section through a portion of the guide pole fitting indicated by Section 5—5 in FIG. 4 that illustrates an attachment assembly for the pole sleeve and pole wiper to the sliding cover.
Figure 7:
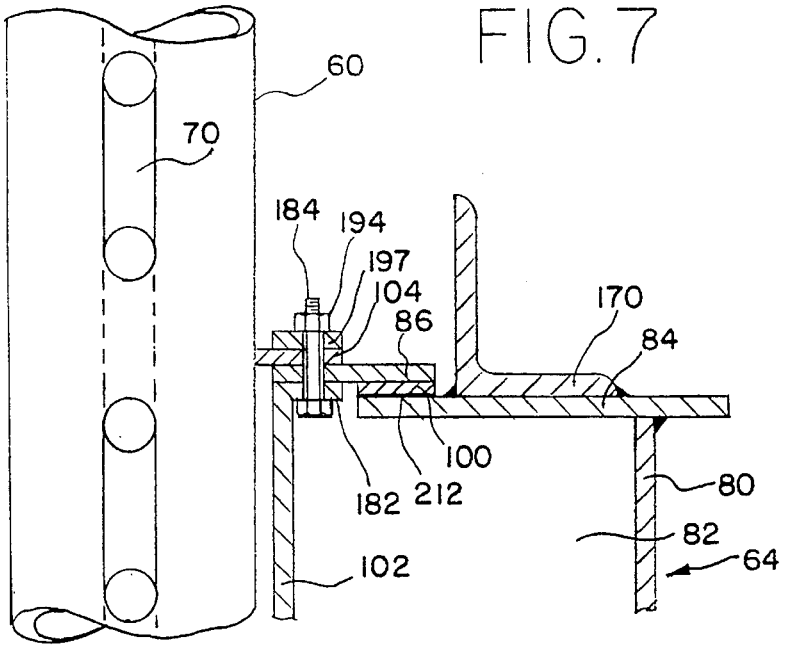
FIG. 7 is an elevation section view through a portion of the guide pole fitting indicated by Section 5—5 in FIG. 4 that illustrates an alternate attachment assembly for the pole sleeve and pole wiper to the sliding cover.
Figure 8:
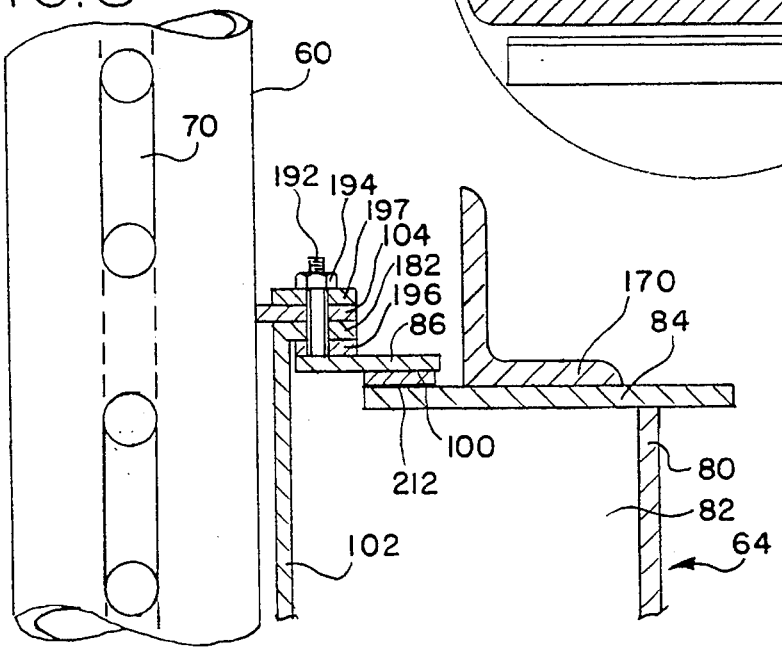
FIG. 8 is an elevation section view through a portion of the guide pole fitting indicated by Section 5—5 of FIG. 4 that illustrates another attachment assembly for the pole sleeve and pole wiper to the sliding cover.

There are at least three methods for connecting the pole sleeve 102 to the sliding cover 86 and they are illustrated in FIGS. 5, 7 and 8. In FIG. 5, the pole sleeve 102 is shown to be connected to the sliding cover 86 by means of a welded or brazed joint. The sliding cover 86 is permitted to slide only in a radial direction from the center of the floating roof 30 and is restrained from moving in other directions by the use of the sliding cover guide angles 170 which are attached to the fixed cover 84 on either side of the sliding cover 86. The sliding cover guide angles 170 may be attached to the fixed cover 84 by means of welding.

Also illustrated in FIG. 5 is a float 106 (shown in phantom lines) having a float wiper 108 above the pole wiper 104 which may provide additional sealing when used with a float wiper 108 near the level of the liquid product 32 in the tank 20, but which may actually increase emissions if not used with a float wiper 108 below the pole wiper 104 because it directs wind down into the hollow guide pole 60 and into contact with the product 32. Therefore, it is desirable to avoid using only one float wiper 108 which is positioned above the pole wiper 104.

FIG. 7 illustrates a second method of connecting the pole sleeve 102 to the sliding cover 86 that involves the use of a bolted connection on the bottom side of the sliding cover 86. The pole sleeve 102 is equipped with a flange 182 to permit the use of bolts 184 and nuts 194 to connect the pole sleeve 102 to the sliding cover 86.

FIG. 8 illustrates a third method of connecting the pole sleeve 102 to the sliding cover 86 that involves the use of a bolted connection on the top side of the sliding cover 86. The pole sleeve 102 is equipped with a flange 182 to permit the use of studs 192 and nuts 194 to connect the pole sleeve 102 to the sliding cover 86. With this method of connection, it is advisable to use a pole sleeve gasket 196 that is located between the top surface of the sliding cover 86 and the bottom surface of the pole sleeve flange 182.

FIGS. 5, 7 and 8 also illustrate three methods of attaching the pole wiper 104 to the sliding cover 86. FIG. 5 illustrates placement of the pole wiper 104 on the top surface of the sliding cover 86. A pole wiper retainer plate 197, studs 193 attached to the sliding cover 86, and nuts 194 are used to attach the pole wiper 104 to the sliding cover 86.

FIG. 7 illustrates a second means of attaching the pole wiper 104 to the sliding cover 86 that is similar to the means that is illustrated in FIG. 5, with the difference that bolts 184 are used instead of studs 193.

FIG. 8 illustrates a third means of attaching the pole wiper 104 to the sliding cover 86. In this arrangement, the pole wiper 104 rests on the top surface of the pole sleeve flange 182. The pole wiper 104 is held in place with pole wiper retainer plate 197, studs 192 attached to the sliding cover 86, and nuts 194.

Figure 6:
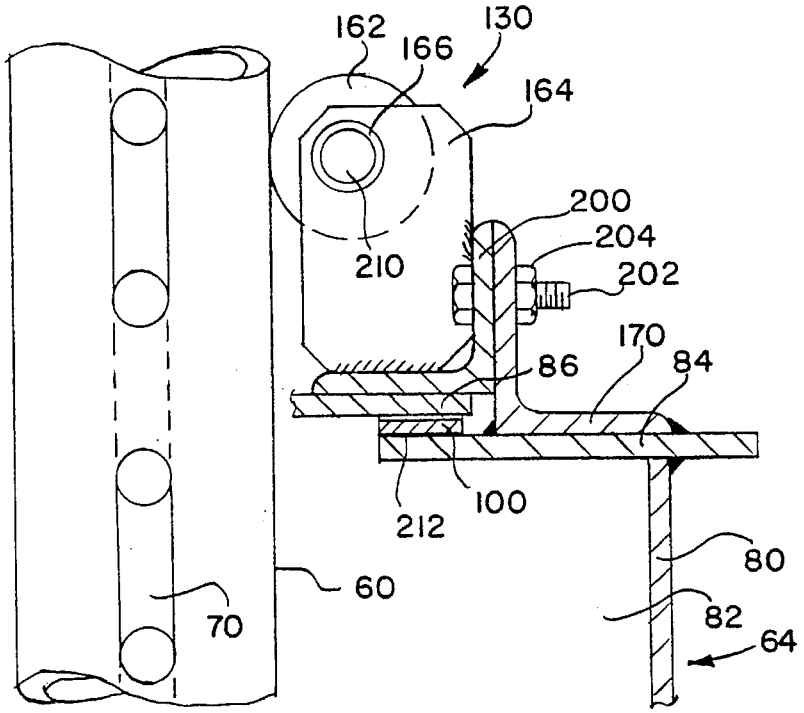
FIG. 6 is an elevation section view through a portion of the guide pole fitting indicated by Section 6—6 in FIG. 4 that illustrates an attachment assembly for the rollers to the sliding cover retainer angles.

FIG. 6 illustrates one means for mounting the rollers 162 on the guide pole fitting 64. Sliding cover retainer angles 200 are attached to the sliding cover guide angles 170 with bolts 202 and nuts 204. The sliding cover retainer angle 200 defines a sliding recess in which sliding cover 86 is permitted to move in a radial direction relative to the center of the floating roof 30, but prevents the sliding cover 86 from moving vertically off of the top surface of the well gasket 100. The retainer angle 200 need not be in constant contact with the sliding cover 86 so long as the sliding cover 86 is prevented from lifting off the well gasket 100 as the floating roof 30 descends. At other times, the weight of the sliding cover 86 is sufficient to maintain contact with the well gasket 100.

A roller support plate 164 may be attached to the sliding cover retainer angle 200 by welding or other suitable methods. Circular brass bushings 166 are located in the roller support plates 164 to accommodate the shaft 210 of the rollers 162. The rollers 162 may be fabricated of stainless steel, brass or other suitable material that minimizes the generation of sparks. The rollers may be made of carbon steel.

Figure 9:
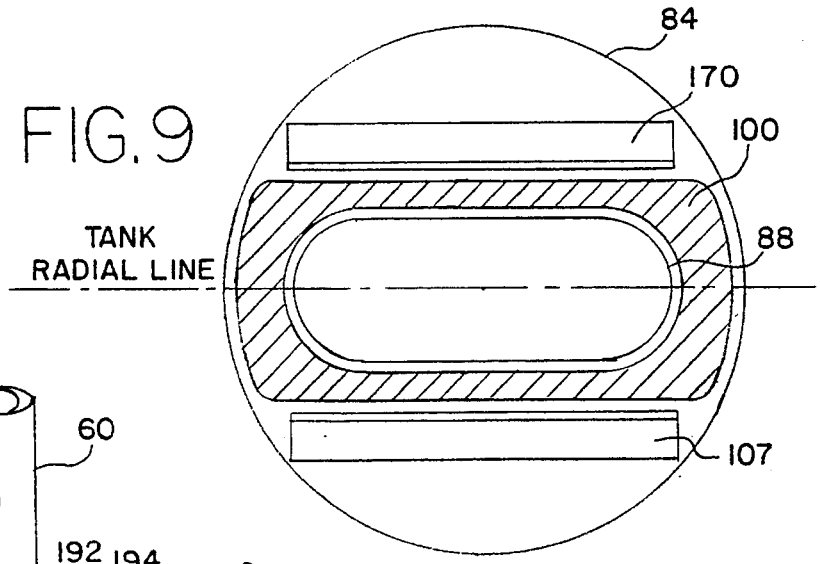
FIG. 9 is a plan view of the fixed cover illustrating the sliding cover guide angles and the well gasket.

FIG. 9 is a plan view of the top surface of the fixed cover 84, which defines elongated opening 88 to permit vertical passage of the guide pole 60. The width of the opening 88 is somewhat larger than the outside diameter of the guide pole 60. The opening 88 is elongated in the radial direction from the center of the floating roof 30 to permit some radial movement of the floating roof 30 relative to the guide pole 60. The well gasket 100 may be cut to the shape illustrated in FIG. 9 so as to completely surround the opening 88, yet fit between the sliding cover guide angles 170. The well gasket 100 may be attached to the top surface of the fixed cover 84 with a suitable adhesive 212, as illustrated in FIGS. 5, 6, 7 and 8.

The foregoing detailed description has been given for clearness of understanding only, and no unnecessary limitation should be understood therefrom, as modifications will be obvious to those skilled in the art.

We claim:

1. A guide pole fitting seal for a liquid product storage tank having a floating roof and a guide pole well in the floating roof, the guide pole well defining an opening through which a hollow guide pole extends, the guide pole defining a plurality of perforations at elevations above and below the floating roof, the guide pole fitting seal comprising:

(a) a well gasket supported by the guide pole well;

(b) a sliding cover bearing on the well gasket, the sliding cover defining an opening through which the guide pole extends;

(c) a pole sleeve joined to and extending downwardly from the sliding cover to at least the level of product stored in the tank, the pole sleeve defining a bore through which the guide pole extends;

(d) a pole wiper joined to the sliding cover in wiping engagement with the guide pole; and (e) a float positioned inside the hollow guide pole and having means for floating on the liquid product that is within the guide pole; and (f) a float wiper joined to the float and in wiping engagement with the inside surface of the guide pole at an elevation below the pole wiper.

2. The guide pole fitting seal of claim 1, and further comprising:

(a) a fixed cover joined to the guide pole well and in bearing support of the well gasket, the fixed cover defining an opening through which the guide pole extends.

3. The guide pole fitting of claim 1, and further comprising:

(a) a guide joined to the floating roof, the guide having means for restraining rotational movement of the floating roof to protect the pole sleeve and pole wiper from damage.

4. The guide pole fitting seal of claim 1, and further comprising:

(a) a pair of sliding cover guide angles joined to the guide pole well on opposing sides of the guide pole and oriented substantially parallel to the radius from the center of the floating roof to the center of the guide pole;

(b) retainer angles joined to each sliding cover guide angle over the sliding cover, the sliding cover retainer angles having means for maintaining the sliding cover in contact with the well gasket as the floating roof descends; and (c) a pair of substantially horizontal and elongated rollers rotatably joined to the retainer angles and bearing on the guide pole, each roller having a longitudinal axis oriented substantially parallel to the radius from the center of the floating roof to the center of the guide pole.

5. The guide pole fitting seal of claim 4 in which the rollers are made of a material selected from the group consisting of:

(a) carbon steel;

(b) stainless steel; or (c) brass.

6. The guide pole fitting seal of claim 1 in which the well gasket is fixed from moving relative to the guide pole well and in sliding engagement with the sliding cover.

7. The guide pole fitting seal of claim 1 in which the pole sleeve includes a horizontal flange joined to the sliding cover and further comprising:

(a) a gasket between the flange and the sliding cover.

8. The guide pole fitting seal of claim 1 in which the well gasket and pole wiper are made of a material selected from the group consisting of:

(a) Neoprene;

(b) Buna-N/Vinyl; or (c) Viton.

9. The guide pole fitting seal of claim 1 in which the pole sleeve and sliding cover are made of a material selected from the group consisting of:

(a) stainless steel;

(b) brass; or (c) aluminum.

10. A guide pole fitting seal for a liquid product storage tank having a floating roof, and a guide pole well in the floating roof, the guide pole well defining an opening through which a guide pole extends, the guide pole fitting seal comprising:

(a) a well gasket supported by the guide pole well;

(b) a sliding cover bearing on the well gasket, the sliding cover defining an opening through which the guide pole extends;

(c) a pole sleeve joined to and extending downwardly from the sliding cover to at least the level of product stored in the tank, the pole sleeve defining a bore through which the guide pole extends, the pole sleeve is flexible; and (d) a pole wiper joined to the sliding cover in wiping engagement with the guide pole at an elevation below the pole wiper.

11. The guide pole fitting seal of claim 10 in which the pole sleeve is made of a flexible sheet material.

12. The guide pole fitting seal of claim 10 in which the pole sleeve is a flexible sheet made of a material selected from the group consisting of:

(a) Neoprene;

(b) Buna-N/Vinyl; or (c) Viton.

13. The guide pole fitting seal of claim 12 in which the flexible sheet is reinforced with a fabric selected from the group consisting of:

(a) Nylon;

(b) Polyester fabric; or (c) Fiberglass fabric.

14. A guide pole fitting seal for a liquid product storage tank having a floating roof and a guide pole well in the floating roof, the guide pole well defining an opening through which a hollow guide pole extends, the guide pole defining a plurality of openings at elevations above and below the floating roof, the guide pole fitting seal comprising:

(a) a well gasket supported by the guide pole well;

(b) a sliding cover bearing on the well gasket, the sliding cover defining an opening through which the guide pole extends;

(c) a pole sleeve joined to and extending downwardly from the sliding cover to at least the level of product stored in the tank, the pole sleeve defining a bore through which the guide pole extends;

(d) a pole wiper joined to the sliding cover in wiping engagement with the guide pole;

(e) a float positioned inside the hollow guide pole and having means for floating on the liquid product that is within the guide pole; and (f) a float wiper joined to the float and in wiping engagement with the inside surface of the guide pole at an elevation below the pole wiper.

15. The guide pole fitting seal of claim 14, and further comprising:

(a) a fixed cover joined to the guide pole well and in bearing support of the well gasket, the fixed cover defining an opening through which the guide pole extends.

16. The guide pole fitting seal of claim 14, and further comprising:

(a) a guide joined to the floating roof, the guide having means for restraining rotational movement of the floating roof to protect the pole sleeve and pole wiper from damage.

17. The guide pole fitting seal of claim 14, and further comprising:

(a) a pair of sliding cover guide angles joined to the guide pole well on opposing sides of the guide pole and oriented substantially parallel to the radius from the center of the floating roof to the center of the guide pole;

(b) retainer angles joined to each sliding cover guide angle over the sliding cover, the sliding cover retainer angles having means for maintaining the sliding cover in contact with the well gasket as the floating roof descends; and (c) a pair of substantially horizontal and elongated rollers rotatably joined to the retainer angles and bearing on the guide pole, each roller having a longitudinal axis oriented substantially parallel to the radius from the center of the floating roof to the center of the guide pole.

18. The guide pole fitting seal of claim 17 in which the rollers are made of a material selected from the group consisting of:

(a) carbon steel;

(b) stainless steel; or (c) brass.

19. The guide pole fitting seal of claim 14 in which the well gasket is fixed from moving relative to the guide pole well and in sliding engagement with the sliding cover.

20. The guide pole fitting seal of claim 14 in which the pole sleeve includes a horizontal flange joined to the sliding cover and further comprising:

(a) a gasket between the flange and the sliding cover.

21. The guide pole fitting seal of claim 14 in which the float wiper is joined to the float at an elevation below the pole wiper, and further comprising:

(a) a second float wiper joined to the float at an elevation above the pole wiper and in wiping engagement with the inside of the guide pole.

22. The guide pole fitting seal of claim 14 in which the well gasket, pole wiper, and float wiper are made of a material selected from the group consisting of:

(a) Neoprene;

(b) Buna-N/Vinyl; or (c) Viton.

23. The guide pole fitting seal of claim 14 in which the pole sleeve and sliding cover are made of a material selected from the group consisting of:

(a) stainless steel;

(b) brass; or (c) aluminum.

24. A guide pole fitting seal for a liquid product storage tank having a floating roof and a guide pole well in the floating roof, the guide pole well defining an opening through which a hollow guide pole extends, the guide pole defining a plurality of openings at elevations above and below the floating roof, the guide pole fitting seal comprising:

(a) a well gasket supported by the guide pole well;

(b) a sliding cover bearing on the well gasket, the sliding cover defining an opening through which the guide pole extends;

(c) a pole sleeve joined to and extending downwardly from the Sliding cover to at least the level of product stored in the tank, the pole sleeve defining a bore through which the guide pole extends, the pole sleeve is flexible;

(d) a pole wiper joined to the sliding cover in wiping engagement with the guide (e) a float positioned inside the hollow guide pole and having means for floating on the liquid product that is within the guide pole; and (f) a float wiper joined to the float and in wiping engagement with the inside surface of the guide pole at an elevation below the pole wiper.

25. The guide pole fitting seal of claim 24 in which the pole sleeve is made of a flexible sheet material.

26. The guide pole fitting seal of claim 24 in which the pole sleeve is a flexible sheet made of a material selected from the group consisting of:

(a) Neoprene;

(b) Buna-N/Vinyl; or (c) Viton.

27. The guide pole fitting seal of claim 26 in which the flexible sheet is reinforced with a fabric selected from the group consisting of:

(a) Nylon;

(b) Polyester fabric; or (c) Fiberglass fabric.

28. A guide pole fitting seal for a liquid product storage tank having a floating roof and a guide pole well in the floating roof, the guide pole well defining an opening through which a hollow guide pole extends, the guide pole defining a plurality of openings at elevations above and below the floating roof, the guide pole fitting seal comprising:

(a) a fixed cover joined to the guide pole well, the fixed cover defining an opening through which the guide pole extends;

(b) a well gasket supported by the fixed cover;

(c) a sliding cover bearing on the well gasket, the sliding cover defining an opening through which the guide pole extends;

(d) a pole sleeve joined to and extending downwardly from the sliding cover to at least the level of the liquid product stored in the tank, the pole sleeve defining a bore through which the guide pole extends;

(e) a pole wiper joined to the sliding cover in wiping engagement with the guide pole;

(f) a float positioned inside the hollow guide pole and having means for floating on the liquid product that is within the guide pole; and (g) a float wiper joined to the float and in wiping engagement with the inside surface of the guide pole at an elevation below the pole wiper.

29. The guide pole fitting seal of claim 28, and further comprising:

(a) a guide joined to the floating roof, the guide having means for restraining rotational movement of the floating roof to protect the pole sleeve and pole wiper from damage.

30. The guide pole fitting seal of claim 28, and further comprising:

(a) a pair of sliding cover guide angles joined to the guide pole well on opposing sides of the guide pole and oriented substantially parallel to the radius from the center of the floating roof to the center of the guide pole;

(b) retainer angles joined to each sliding cover guide angle over the sliding cover, the sliding cover retainer angles having means for maintaining the sliding cover in contact with the well gasket as the floating roof descends; and (c) a pair of substantially horizontal and elongated rollers rotatably joined to the retainer angles and bearing on the guide pole, each roller having a longitudinal axis oriented substantially parallel to the radius from the center of the floating roof to the center of the guide pole.

31. The guide pole fitting seal of claim 30 in which the rollers are made of a material selected from the group consisting of:

(a) carbon steel;

(b) stainless steel; or (c) brass.

32. The guide pole fitting seal of claim 28 in which the well gasket is fixed to the fixed cover and in sliding engagement with the sliding cover.

33. The guide pole fitting seal of claim 28 in which the pole sleeve includes a horizontal flange joined to the sliding cover, and further comprising:

(a) a gasket between the flange and the sliding cover.

34. The guide pole fitting seal of claim 28 in which the well gasket, pole wiper, and the float wiper are made of a material selected from the group consisting of:

(a) Neoprene;

(b) Buna-N/Vinyl; or (c) Viton.

35. The guide pole fitting seal of claim 28 in which the float wiper is joined to the float at an elevation below the pole wiper, and further comprising:

(a) a second float wiper joined to the float at an elevation above the pole wiper and in wiping engagement with the inside of the guide pole.

36. The guide pole fitting seal of claim 28 in which the pole sleeve and sliding cover are made of a material selected from the group consisting of:

(a) stainless steel;

(b) brass; or (c) aluminum.

37. A guide pole fitting seal for a liquid product storage tank having a floating roof and a guide pole well in the floating roof, the guide pole well defining an opening through which a hollow guide pole extends, the guide pole defining a plurality of openings at elevations above and below the floating roof, the guide pole fitting seal comprising:

(a) a fixed cover joined to the guide pole well, the fixed cover defining an opening through which the guide pole extends;

(b) a well gasket supported by the fixed cover;

(c) a sliding cover bearing on the well gasket, the sliding cover defining an opening through which the guide pole extends;

(d) a pole sleeve joined to and extending downwardly from the sliding cover to at least the level of the liquid product stored in the tank, the pole sleeve defining a bore through which the guide pole extends, the pole sleeve is flexible;

(e) a pole wiper joined to the sliding cover in wiping engagement with the guide pole;

(f) a float positioned inside the hollow guide pole and having means for floating on the liquid product that is within the guide pole; and (g) a float wiper joined to the float and in wiping engagement with the inside surface of the guide pole at an elevation below the pole wiper.

38. The guide pole fitting seal of claim 37 which the pole sleeve is a flexible sheet made of a material selected from the group consisting of:

(a) Neoprene;

(b) Buna-N/Vinyl; or (c) Viton.

39. The guide pole fitting seal of claim 38 in which the flexible sheet is reinforced with a fabric selected from the group consisting of:

(a) Nylon;

(b) Polyester fabric; or (c) Fiberglass fabric.

40. The guide pole fitting seal of claim 37 in which the pole sleeve is made of a flexible sheet material.

41. A method of sealing a guide pole fitting for a tank having a floating roof and a guide pole well in the floating roof, the guide pole well defining a bore through which a guide pole extends, the guide pole defining a plurality of openings at elevations above and below the floating roof, the method comprising the steps of:

(a) sealing an interface between the guide pole well and a sliding cover, the sliding cover defining an opening through which the guide pole extends;

(b) sealing a space between the sliding cover and the guide pole;

(c) sealing the openings in the guide pole that are contained within the guide pole well with a pole sleeve joined to and extending downward from the sliding cover to at least the level of the product in the tank; and (d) sealing the horizontal cross-section of the inside of the guide pole.

42. The method of claim 41, and further comprising the step of:

(a) restraining rotational movement of the floating roof about a vertical axis to protect the sealing elements.

* * * * *